United States Patent [19]

Morgan et al.

[11] Patent Number: 4,883,110

[45] Date of Patent: Nov. 28, 1989

[54] EVAPORABLE FOAM PATTERN FOR USE IN A CASTING PROCESS AND HAVING LOAD TRANSFER WALLS

[75] Inventors: Edward J. Morgan, North Fond du Lac; William D. Corbett, Fonde du Lac, both of Wis.

[73] Assignee: Brunswick Corporation, Skokie, Ill.

[21] Appl. No.: 263,006

[22] Filed: Oct. 26, 1988

[51] Int. Cl.[4] ..... B22C 7/02

[52] U.S. Cl. ..... 164/249; 164/246; 164/45

[58] Field of Search ..... 164/34, 35, 36, 245, 164/246, 249, 45

[56] References Cited

U.S. PATENT DOCUMENTS

| | | | |
|---|---|---|---|
| 4,632,169 | 12/1986 | Morgan et al. | 164/34 |
| 4,640,333 | 2/1987 | Martin et al. | 164/34 |
| 4,657,063 | 4/1987 | Morris | 164/34 |
| 4,777,997 | 10/1988 | Corbett | 164/34 |

*Primary Examiner*—Richard K. Seidel

*Attorney, Agent, or Firm*—Andrus, Sceales, Starke & Sawall

[57] ABSTRACT

An evaporable foam pattern for use in casting a metal part, such as an engine block. The pattern includes a first evapoable foam section having an outer peripheral rim and an internal wall which is spaced from the rim. The pattern also includes a second pattern section having a rim disposed in abutting engagement with the rim of the first section and having an internal wall spaced from the rim and disposed in abutting engagement with the internal wall of the first section. A third pattern section is disposed outwardly of said second section and has a rim disposed in abutting engagement with the rim of the second section. A layer of adhesive or glue is disposed between the abutting rims and between the abutting internal walls. Load transmitting members interconnecting the outer surface of the second pattern section with the inner surface of the third pattern section and are located in load transmitting alignment with the abutting internal walls so that an external clamping force applied to the outer surface of the third section during the gluing operation will be transmitted through the load transmitting members to the abutting internal walls to maintain the walls in tight bearing engagement. The clamping forces are thus resisted by direction compression of the thin foam walls rather than by bending of the foam.

11 Claims, 2 Drawing Sheets

EVAPORABLE FOAM PATTERN FOR USE IN A CASTING PROCESS AND HAVING LOAD TRANSFER WALLS

BACKGROUND OF THE INVENTION

Evaporable foam patterns made of polystyrene, or the like, are frequently employed in casting operations, particularly when casting articles of complex configurations, such as internal combustion cylinder blocks or other engine components. In the typical evaporable foam casting process, the pattern, which conforms in shape to the metal part to be cast, is positioned in an outer mold and a flowable material, such as sand, is introduced into the mold to surround the pattern and fill the cavities of the pattern. When molten metal is introduced into the mold, the metal will vaporized the foam pattern, with the vapor passing into the interstices of the sand while the metal fills the void produced by evaporation of the foam pattern, thereby resulting in a cast metal part having a configuration identical to the evaporable foam pattern.

The evaporable foam pattern for a two-cycle engine generally includes an cylinder block pattern section, an exhaust passage cover section, and a water passage cover section, which are joined together by a glue or adhesive along mating interfaces. The cylinder block pattern section has an outer peripheral rim and an internal wall spaced inwardly from the rim to define a water passage, while the area within the internal wall constitutes an exhaust manifold passage which communicates through exhaust ports with the cylinders of the engine.

The exhaust passage cover section also includes a rim that abuts the rim on the engine block section and the inner surface of the exhaust passage cover section is formed with an internal wall that is spaced inwardly from the rim and abuts the internal wall of the cylinder block section. The central portion of the exhaust passage cover section encloses the exhaust manifold passage in the engine block section.

The water passage cover section has a peripheral rim that is in abutting relation with the rim of the exhaust passage cover section, and the central portion of the water passage cover section, located within the rim defines a water chamber which communicates with the peripheral water passage of the exhaust passage cover section.

The pattern sections are joined together by applying a layer of glue or adhesive to the mating rim surfaces, as well as to the mating internal walls between the cylinder block section and the exhaust passage cover section. A force is applied to the sections during the gluing operation and it has been found that if the force is only applied through the abutting rims, the internal walls of the cylinder block section and exhaust passage cover section will not be adequately bonded, with the result that the internal walls of the metal casting could be defective. On the other hand, if the force is applied over the entire surface of the cover, the thin walled water passage cover section tends to deform inwardly and the abutting external walls may not be properly bonded.

Because of these problems, in obtaining adequate bonding of the abutting walls, it has been the practice to separately bond the exhaust passage cover to the cylinder block section, and after the adhesive is fully set, the water passage cover section is then bonded to the exhaust passage cover section in a separate bonding operation. This procedure of course, substantially increases the overall time required to fabricate the pattern.

SUMMARY OF THE INVENTION

The invention is directed to an evaporable foam pattern for use in producing a metal casting and in particular to a foam pattern having internal load transfer walls which act to distribute the force applied during assembly of the pattern from an outer pattern section to an inner pattern section to thereby enable the sections to be bonded together in a single gluing operation and provide a more precise pattern.

In utilizing the invention to bond or glue thin, flexible, multi-layered foam plastic parts, the walls corresponding to the glued surface extend across each of the flexible foam parts so that clamping forces during clamping are resisted by directed compression of the foam walls aligned with the glued surface rather than by bending of the foam. When gluing thin flexible foam parts to larger stiffer foam parts, walls corresponding to the glued surfaces are securely tied into the larger foam part so as to be stiff in compression.

When the invention is utilized in casting an engine block, the assembled pattern includes a cylinder block pattern section, an exhaust pattern section, and a water passage cover section. One side of the cylinder block pattern section is formed with a recess which constitutes an exhaust manifold passage and the exhaust manifold passage is bordered by an internal wall. Spaced outwardly from the internal wall is a peripheral rim and the space between the wall and the rim defines a water passage.

The inner surface of the exhaust passage cover section includes an internal wall which mates with the internal wall of the engine block section and the central portion of the exhaust passage cover section, located inwardly of the wall, closes off the exhaust manifold passage. In addition, the exhaust passage cover section has a peripheral rim that is spaced outwardly of the internal wall and water passages extend between the rim and the internal wall and communicates with the water passage in the cylinder block section.

The outer water passage cover section is provided with a peripheral rim which abuts and mates with the rim on the exhaust passage cover section and the central portion of the water passage cover section located inwardly of the rim, defines a water chamber which communicates with the peripheral water passages. In accordance with the invention, the outer surface of the exhaust passage cover section and inner surface of the water passage cover section are formed with a plurality of spaced, abutting load transfer lands. The lands are disposed in direct load-transmitting alignment with the abutting internal walls of the cylinder block section and exhaust passage cover section. Glue or adhesive is applied between the abutting rim surfaces, as well as between the abutting internal wall surfaces and the abutting lands. Through use of the lands, a clamping force applied to the outer surface of the water passage cover section will be transmitted through the lands directly to the abutting internal wall surfaces of the cylinder block section and the exhaust passage cover section to insure that these surfaces are adequately bonded by the adhesive.

With the assembly method of the invention, all three pattern sections can be glued together at the same time, as opposed to prior processes, in which the sections were glued in separate stages. Thus, the overall speed of assembly of the pattern is substantially increased.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The invention is directed to an evaporable foam pattern for casting a metal part and in particular to an evaporable foam pattrn that can be utilized in casting the engine block of a two-cycle engine. The pattern is formed of a material, such as polystyrene, which is positioned within an outer mold and a flowable material, such as sand, is introduced into the mold and surrounds the pattern, as well as filling the voids or cavities of the pattern. When molten metal is introduced into the mold, the molten metal will vaporize the pattern with the vapor being trapped in the interstices of the sand, while the metal fills the voids created by vaporization of the foam pattern. The resulting cast metal part has a configuration identical to that of the evaporable foam pattern.

As the cast metal engine block is identical in configuration to the pattern, terminology of the components of the metal block will be used in describing the evaporable foam pattern.

Figure 5:
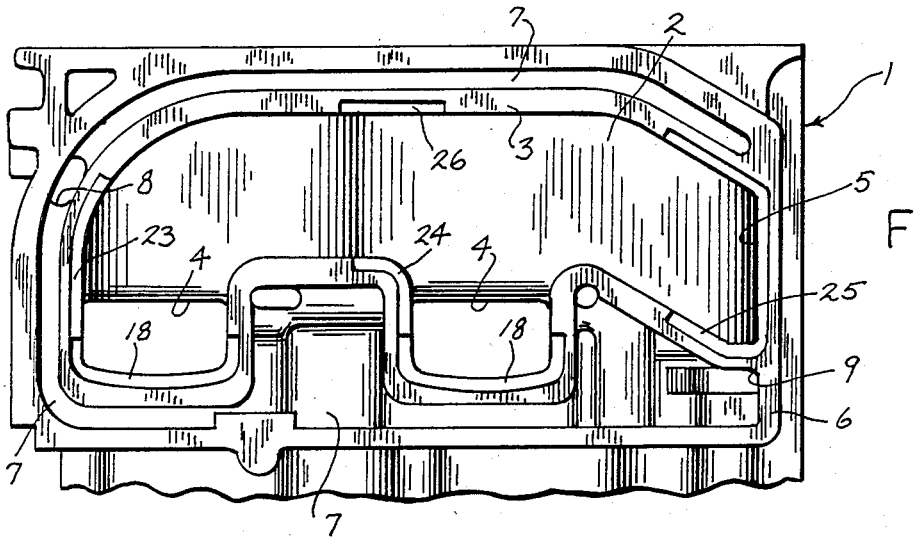
FIG. 5 is an plan view of the cylinder block pattern section.
Figure 6:
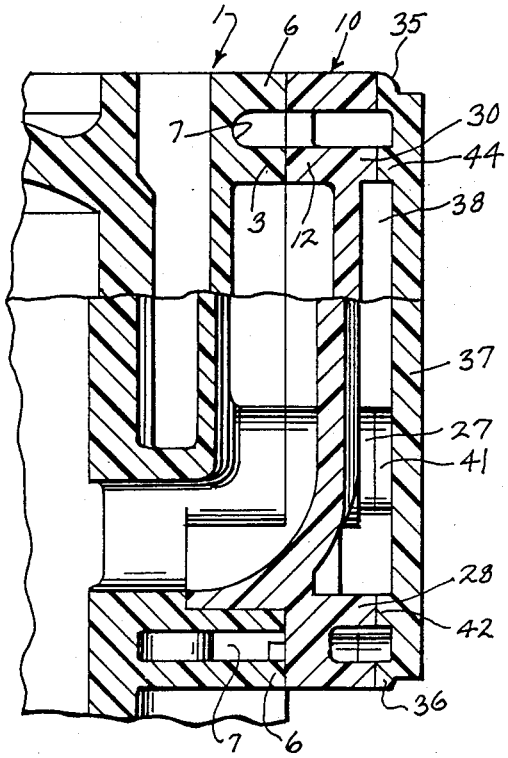
FIG. 6 is a transverse section taken along line 6—6 of FIG. 1.

The pattern, as employed in casting a metal engine block for a two-cycle engine, includes a cylinder block pattern section 1, which can be formed of one or more evaporable foam portions, that are glued together along mating interfaces. One side of the cylinder block section, as shown in FIG. 5, is formed with a recess which defines an exhaust manifold passage 2, and the exhaust manifold passage 2 is bordered by a thin internal wall 3. Exhaust manifold passage 2 is connected to a pair of exhaust passages 4 that communicate with the cylinders of the engine and the manifold passage 2 terminates in an outlet 5 located at the side of the cylinder block section.

Located outwardly of internal wall 3 is a peripheral rim 6 and the space between the wall 2 and rim 6 defines a water passage 7. Openings 8 and 9 communicate with passage 7 and act to conduct cooling water to various other cooling passages in the cylinder bock and cylinder heads.

Figure 4:
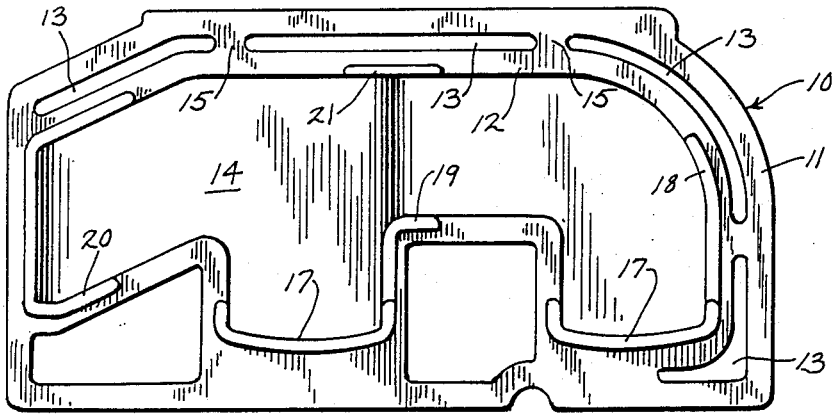
FIG. 4 is an plan view of the inner surface of the exhaust passage cover section.

The evaporable foam pattern also includes an exhaust passage cover section 10 having a peripheral rim 11 which abuts the rim 6 on block pattern 1. As shown in FIG. 4, the inner surface of section 10 is formed with an internal wall 12 that is spaced inwardly of rim 11 and water passages 13 extend between rim 11 and wall 12 and communicate with water passage 7 of cylinder block section 1. The central section 14 of pattern section 10, located inwardly of wall 12, acts to close off the outer side of the exhaust manifold passage 2.

As the rim 11 is a relatively thin section, reinforcements 15 interconnect the rim 11 with internal wall 12 and the reinforcements 15 only extend a portion of the depth of the rim, so as not to impede flow of water through the passage 13. In addition, connecting web 16 also connects portions of the rim 11 to internal wall 12 and again webs 16 only extend a portion of the depth of the rim so as not to impede water flow through the passage 13.

The inner surface of section 10 which faces cylinder block section 1 is provided with a pair of generally U-shaped locators 17, as shown in FIG. 4, which are inserted within the exhaust passages 4 of pattern section 1. As shown in FIG. 5, the internal wall 3 is formed with ledges 18 and the inner edges of locators 17 seat against ledges 18.

In addition to locators 17, the inner surface of section 10 is also formed with locators 18, 19, 20 and 21 which seat against ledges 23, 24, 25 and 26, respectively, in cylinder block section 1. The locators 17–22 ensure that the exhaust passage cover section 10 is precisely positioned with respect to the cylinder block section 1 and that the abutting surfaces of rims 6 and 11, as well as the abutting surfaces of walls 2 and 12 are in precise alignment.

Figure 1:
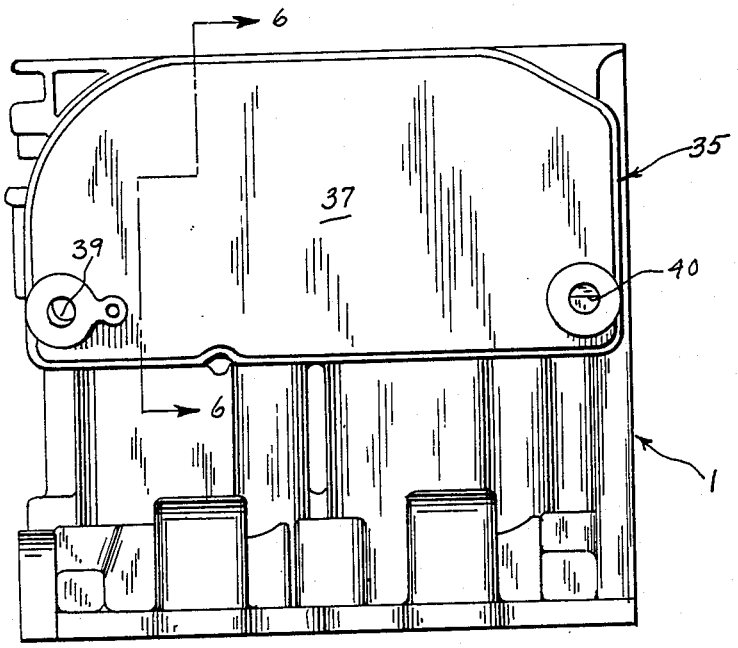
FIG. 1 is a side elevation of an evaporable foam engine block pattern.
Figure 2:
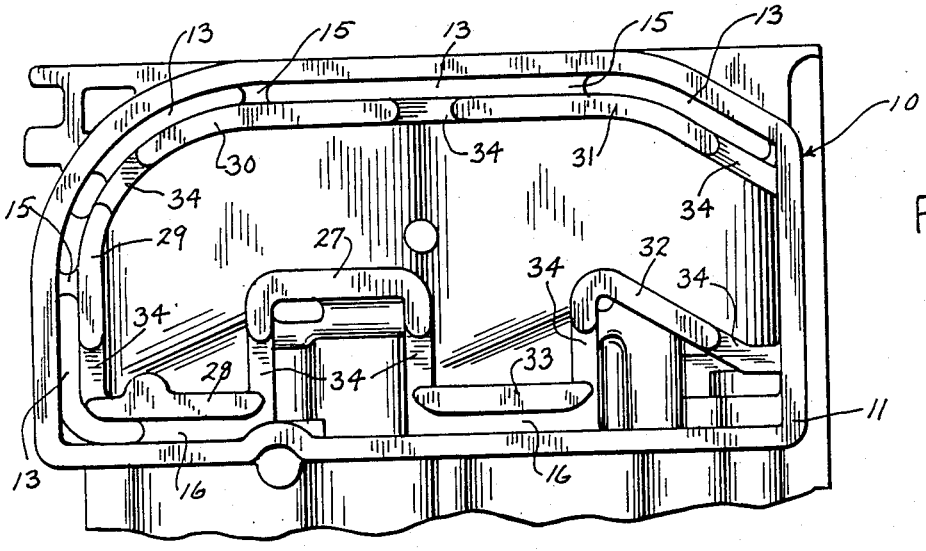
FIG. 2 is a plan view of the outer surface of the exhaust passage cover section.

In accordance with the invention, the outer surface of section 10 is provided with a series of spaced lands or projections 27–33 separated by gaps 34, as illustrated in FIG. 2. Lands 27–33 are in direct load transmitting alignment with wall 12 on opposite sides of section 10.

Figure 3:
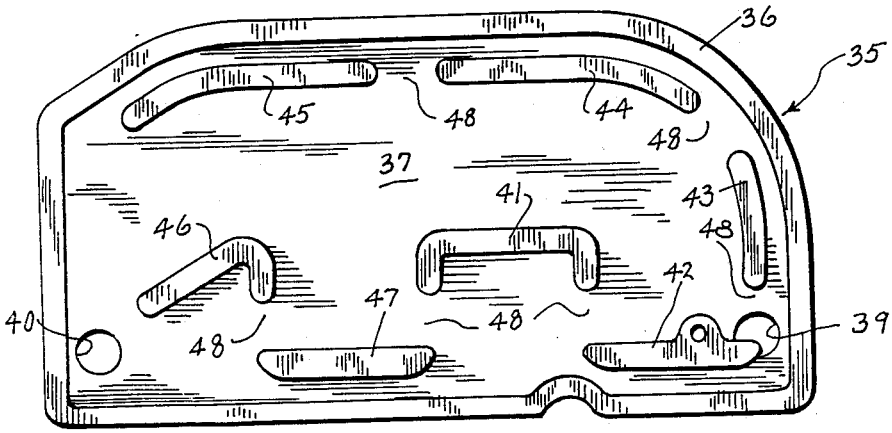
FIG. 3 is a plan view of the inner surface of the water passage cover section.

The outer face of exhaust passage cover section 10 is enclosed by water passage cover section 35. As shown in FIG. 3 the inner surface of section 35 is formed with a peripher rim 36 which mates with rim 11 of section 10. Rim 36 borders a central section 37 which is spaced from the central section 14 and defines a water chamber 38. Cover section 35 is also formed with an inlet opening 39 and an outlet opening 40 which communicate with the water passages.

In addition, the inner surface of central section 37 is formed with a group of lands 41–47, which are adapted to abut and engage the lands 27–33 on section 10. More specifically, the U-shaped land 41 is adapted to engage U-shaped land 27, while land 42 engages land 28. Similarly, lands 43, 44, 45, 46 and 47 engage the respective walls 29, 30, 31 32 and 33. The lands 41–47 have the same configuration and area as the corresponding wall sections 27–33 and gaps 48 are provided between the lands which are aligned with gaps 34 on section 10.

The pattern sections 1, 10 and 35 are connected together by applying a coating of glue or adhesive, of the type commonly used in assembling evaporable foam patterns, between the mating surfaces. More particularly, a layer of glue is applied to the abutting surfaces of rims 6, 11, and 36 as well as between the abutting surfaces of internal walls 2 and 12. In addition, a layer of glue can be applied between the abutting and lands 27–33 and 41–47. The glue is a conventional type used in the fabrication of evaporable foam patterns.

When a clamping force is applied against the outer surface of water passage cover section 35 during the gluing operation, the pressure will be transmitted through the mating lands to the internal walls 12 and 3. This ensures that the walls 12 and 3 are securely bonded together and prevent any deformation of the thin walled cover section 35. The clamping forces are thus resisted by direct compression of the thin foam plastic walls alinged with the glued surfaces rather than by bending of the foam.

The invention also enables the glue to be applied between all three sections 1, 10 and 35 at the same time and eliminates the two-stage gluing operation as used in the past, in which the section 10 would be initially glued to section 1, and subsequently the section 35 glued to the preassembled sections 1 and 10. As the entire gluing operation can be carried out in one step, the time required for assembly of the evaporable foam pattern is substantially reduced.

While the above description has been directed to the gluing of an exhaust passage cover section and a water passage cover section to a cylinder block pattern section, it is contemplated that the invention can be utilized in joining other thin, flexible, multi-layer foam pattern pieces.

Various modes of carrying out the invention are contemplated as being within the scope of the following claims particulary pointing out and distinctly claiming the subject matter which is regarded as the invention.

We claim:

1. An evaporable foam pattern for use in producing a metal casting, comprising a first evaporable foam pattern section having a first outer peripheral rim and having a first internal wall spaced from said rim, a second evaporable foam pattern section having a second rim disposed in abutting engagement with said first rim and having a second internal wall spaced from said second rim and disposed in abutting engagement with said first internal wall, a third evaporable foam pattern section having a third rim disposed in abutting engagement with said second rim, a layer of adhesive disposed between said abutting rims and beween said abutting internal walls, and load transmitting means interconnecting the outer surface of said second pattern section with the inner surface of said third pattern section, said load transmitting means being disposed in load transmitting alignment with said abutting first and second internal walls whereby an external force applied to the outer surface of said third pattern section will be transmitted through said load transmitting means to said abutting internal walls to maintain said abutting internal walls in tight bearing engagement after application of said ahesive layer to said abutting internal walls.

2. The pattern of claim 1, wherein said load transmitting means comprises land means integrally formed with at least one of said second and third sections and disposed to engage the other of said second and third sections.

3. The pattern of claims 2, wherein said land means has at least one transverse discontinuity.

4. The pattern of claim 2, wherein each land is interrupted by a plurality of spaced gaps, the gaps in one land being aligned with the gaps in the other land.

5. The pattern of claim 1, wherein said land means comprises a first land projecting outwardly from the outer surface of said second section and a second land projecting inwardly from the inner surface of said third section and disposed in abutting relation with said first land.

6. An evaporable foam engine block pattern, comprising an evaporable foam cylinder block pattern section having an outer peripheral rim and an internal wall spaced inwardly from said rim to provide a water passage therebetween, said cylinder block section having an exhaust manifold passage bordered by said internal wall, an evaporable foam exhaust passage cover section having a rim disposed in abutting relation with the rim of said cylinder block section and having an inwardly facing internal wall disposed in abutting relation with the internal wall of said cylinder block section, the internal wall of said exhaust passage cover section being spaced inwardly of the rim thereon to provide a water passage communicating with the water passage of said cylinder block section, said exhaust passage cover section also having a central portion disposed inwardly of the internal wall and enclosing the exhaust manifold passage, an evaporable foam water passage cover section including a rim disposed in abutting relation with the rim of said exhaust passage cover section, said water passage cover portion including a central portion spaced outwardly of the central portion of the exhaust passage cover section to define a water chamber therebetween, load transmitting means disposed within said water chamber and interconnecting the outer surface of said exhaust passage cover section with the inner surface of said water passage cover section, said load transmitting means being disposed in load transmitting alignment with said abutting internal walls, a layer of adhesive securing the abutting rims together, and a second layer of adhesive joining said abutting internal walls.

7. The pattern of claim 6, wherein said load transmitting means comprises a first land on the outer surface of said exhaust passage cover section and a second land disposed on the inner surface of said water passage cover section and disposed in abutting relation with said first land.

8. The pattern of claim 7, and a third layer of adhesive joining said abutting lands.

9. The pattern of claim 7, said lands having a shape and surface area corresponding to the shape and surface area of said internal walls.

10. The pattern of claim 7, wherein at least one of said lands is provided with a plurality of transverse discontinuities that define cooling water channels.

11. An evaporable foam pattern assembly for producing a metal casting, comprising first evaporable foam pattern means including an outer wall and a first internal wall spaced from the outer wall, second evaporable foam pattern means including a first pattern section having a second internal wall disposed in abutting relation with said first wall, said second pattern means also including a second pattern section having an outer wall portion disposed in bearing engagement with the outer wall of said first pattern means and having a second central portion spaced from said first pattern section to provide a cavity therebetween, adhesive bonding means disposed between said abutting internal walls, load transmitting means disposed in said cavity for transmitting an external force applied to the outer surface of said central portion to said abutting internal walls to maintain said walls in firm intimate contact, said load transmitting means comprising a projection on at least one of said first and second pattern sections and disposed in bearing engagement with the other of said pattern sections, said projection disposed in alignment with said internal walls.

* * * * *